US009285692B2

(12) United States Patent
Mizuta et al.

(10) Patent No.: US 9,285,692 B2
(45) Date of Patent: Mar. 15, 2016

(54) POSITIVELY-CHARGED SINGLE-LAYER ELECTROPHOTOGRAPHIC PHOTORECEPTOR AND IMAGE FORMING APPARATUS

(71) Applicant: KYOCERA Document Solutions Inc., Osaka-shi, Osaka (JP)

(72) Inventors: Yasufumi Mizuta, Osaka (JP); Kazunari Hamasaki, Osaka (JP); Keizo Kimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 23 days.

(21) Appl. No.: 14/036,104

(22) Filed: Sep. 25, 2013

(65) Prior Publication Data

US 2014/0093817 A1 Apr. 3, 2014

(30) Foreign Application Priority Data

Sep. 28, 2012 (JP) ..... 2012-218010

(51) Int. Cl.
*G03G 15/02* (2006.01)
*G03G 17/00* (2006.01)
(Continued)

(52) U.S. Cl.
CPC ..... *G03G 5/047* (2013.01); *G03G 5/043* (2013.01); *G03G 5/0609* (2013.01); *G03G 5/0614* (2013.01)

(58) Field of Classification Search
CPC ..... G03G 5/043; G03G 5/0614; G03G 5/047; G03G 5/0609
USPC ..... 430/56, 69, 58.05, 58.75
See application file for complete search history.

(56) References Cited

U.S. PATENT DOCUMENTS 5,432,038 A 7/1995 Kaatsukawa et al.
5,863,688 A * 1/1999 Watanabe et al. ..... 430/133
(Continued)

FOREIGN PATENT DOCUMENTS

JP 61-110147 5/1986
JP 63-77060 4/1988
(Continued)

OTHER PUBLICATIONS

Japanese Patent Application No. 2012-218010 Office Action—Aug. 4, 2014.
(Continued)

*Primary Examiner* — Thorl Chea
(74) *Attorney, Agent, or Firm* — Gerald E. Hespos; Michael J. Porco; Matthew T. Hespos

(57) ABSTRACT

Disclosed is a positively-charged single-layer electrophotographic photoreceptor in which a photosensitive layer containing at least a binding resin and a charge transporting material is provided on a photosensitive layer support base with a wall thickness of 0.7 mm or less, wherein when the charge transporting material is solely constituted by a hole transporting material, a content of the hole transporting material is 110 parts by mass or less with respect to 100 parts by mass of the binding resin, and when the charge transporting material is constituted by a hole transporting material and an electron transporting material, a content of the hole transporting material is 130 parts by mass or less and a content of the electron transporting material is 5 parts by mass or more with respect to 100 parts by mass of the binding resin.

8 Claims, 2 Drawing Sheets

(51) Int. Cl.

| | |
|---|---|
| ***G03G 5/047*** | (2006.01) |
| ***G03G 5/043*** | (2006.01) |
| ***G03G 5/06*** | (2006.01) |

(56) References Cited

U.S. PATENT DOCUMENTS

| | | | | |
|---|---|---|---|---|
| 2001/0038960 | A1* | 11/2001 | Azuma et al. | 430/56 |
| 2002/0182524 | A1* | 12/2002 | Uchida et al. | 430/58.05 |
| 2003/0049551 | A1* | 3/2003 | Parikh et al. | 430/58.65 |
| 2006/0154159 | A1* | 7/2006 | Lim et al. | 399/159 |
| 2008/0286673 | A1* | 11/2008 | Kuboshima et al. | 430/74 |
| 2010/0323288 | A1* | 12/2010 | Altavela et al. | 430/58.8 |

FOREIGN PATENT DOCUMENTS

| | | |
|---|---|---|
| JP | 6-222576 | 8/1994 |
| JP | 7-155683 | 6/1995 |
| JP | 07-309824 | 11/1995 |
| JP | 8-95265 | 4/1996 |
| JP | 2001-175008 | 6/2001 |
| JP | 2005-181468 | 7/2005 |
| JP | 2006-047716 | 2/2006 |
| JP | 2010-070464 | 4/2010 |

OTHER PUBLICATIONS

Korean Patent Application No. 10-2013-0113844 Office Action—Sep. 18, 2014.

* cited by examiner

POSITIVELY-CHARGED SINGLE-LAYER ELECTROPHOTOGRAPHIC PHOTORECEPTOR AND IMAGE FORMING APPARATUS

BACKGROUND

This application is based on, and claims priority from, Japanese Patent Application No. 2012-218010, filed on Sep. 28, 2012 with the Japan Patent Office, the entire contents of which are incorporated herein by reference.

The present disclosure relates to a positively-charged single-layer electrophotographic photoreceptor and an image forming apparatus comprising the positively-charged single-layer electrophotographic photoreceptor as an image carrier.

Conventionally, organic photo conductors (OPCS) are widely used as photoreceptors in image forming apparatuses. Organic photo conductors can be roughly divided into single-layer organic photo conductors in which a single layer created by dispersing a charge generating material (CGM) and a charge transporting material (CTM) in a binder resin is formed on a support base tube made of aluminum or the like, and organic photo conductors in which a layer containing a CGM and a layer containing a CTM are laminated on a support base tube.

Among organic photo conductors, single-layer organic photo conductors have a simple layer construction and therefore offer superior productivity. In addition, when such a single-layer organic photo conductor is combined with a charging member which adopts a contact-charging system which contacts directly with a photoconductive layer and used as a positively-charged single-layer organic photoreceptor, oxidized gas such as ozone which adversely affects office environment is hardly created.

Therefore, due to such advantages, positively-charged single-layer electrophotographic photoreceptors are becoming more utilized.

An electrophotographic photoreceptor is manufactured by applying a photosensitive material on a circumferential surface of a photoreceptor support base.

In addition, an application method thereof usually involves moving a container (a coating tank) that houses an application liquid of the photoreceptor material and the support base relative to each other, dipping the support base in the application liquid, and pulling the support base out from the container at a predetermined speed.

According to the adopted method, the extracted photoreceptor support base is next immobilized and dried naturally, and subsequently placed in an oven or the like to be completely dried. Since an electrophotographic photoreceptor having a photosensitive coating film with a uniform thickness is manufactured in a short period time, a quick-drying solvent is usually used as a solvent of the application liquid.

When using a quick-drying solvent, although a drying rate of the application liquid can be increased and the application liquid can be solidified in a short period time, since heat loss occurs after dipping at the coating film and the support base due to heat of vaporization as the solvent evaporates between extraction and drying, an abrupt temperature drop occurs and the temperature of the coating film falls to or below dew point. When the temperature of the coating film drops to or below dew point, due to condensation of water vapor in the air, the coating film takes in moisture and causes the surface of the coating film to turn white (a blushing phenomenon). Whitening of the surface of the coating film as described above is not only unfavorable in terms of appearance but is also problematic in that the whitening significantly affects charging characteristics, photosensitivity, and abrasion resistance of the electrophotographic photoreceptor and lead to a fatal defect.

Although characteristics of laminated organic photo conductors are also affected by blushing, the impact on single-layer organic photo conductors is more prominent since the charge generating material exists on the surface of the photo conductor. As a result, an inconvenience in that various characteristics of the photo conductor such as repetition characteristics during continuous use, ozone resistance, and abrasion resistance decline become pronounced.

In consideration of such circumstances, there are demands for suppressing blushing that occurs during production of positively-charged single-layer electrophotographic photoreceptors. Conventionally, a method of preventing the occurrence of blushing has involved bringing a holding member that is used during coating into contact with an inner surface of a support base and adjusting a length and material of the holding member to control a temperature of the support base. However, this method is not sufficient. Furthermore, while attempts have been made involving heating a support base during drying of a coating film (Related Art 1), managing temperature of an application liquid (Related Art 2), managing a difference in temperature between a coating atmosphere and an application liquid (Related Art 3), and controlling humidity of a coating atmosphere (Related Art 4), applying these methods require investment in facilities.

In contrast, as a method of preventing blushing without the use of specialized equipment, a method is proposed in which a solvent used, density, specific heat, and thickness of support base material, and thickness of a formed photoreceptor layer are controlled so as to satisfy specific conditions (Related Art 5).

In recent years, from the perspectives of downsizing, cost reduction, reduction in power consumption, and the like of electrophotographic apparatuses, reductions in size and weight of electrophotographic photoreceptors are desired. In addition, reductions in material cost and necessary drive power with respect to photosensitive layer supports by further weight reduction are also desired. While a reduction in weight of a support base can be readily achieved by reducing wall thickness of the support base, this also causes a decline in heat capacity of the support base itself. Since a decline in heat capacity of the support base makes it easier for heat of vaporization due to evaporation of a solvent during coating of a photosensitive layer to cool the support base down to or below dew point, blushing is more likely to occur.

Therefore, when a thin-walled support base is used, depending on a method of controlling a solvent used, density, specific heat, and thickness of support base material, and thickness of a formed photoreceptor layer so as to satisfy specific conditions as described in Related Art 5, the occurrence of blushing cannot be prevented.

The present disclosure has been made in consideration of the circumstances described above, and an object thereof is to provide a positively-charged single-layer electrophotographic photoreceptor which comprises a blushing-free photosensitive layer on a thin-walled support base.

The present inventors have found that the occurrence of blushing can be prevented with a positively-charged photoreceptor that uses a photosensitive layer support base with a wall thickness of 0.7 mm or less by adjusting a content of charge transporting material to a specific range relative to a binding resin that constitutes the photosensitive layer. The present disclosure is based on these findings.

SUMMARY

An aspect of the present disclosure is a positively-charged single-layer electrophotographic photoreceptor in which a photosensitive layer containing at least a binding resin and a charge transporting material is provided on a photosensitive layer support base with a wall thickness of 0.7 mm or less, wherein the charge transporting material is solely constituted by a hole transporting material, and a content of the hole transporting material is 110 parts by mass or less with respect to 100 parts by mass of the binding resin.

Another aspect of the present disclosure is a positively-charged single-layer electrophotographic photoreceptor in which a photosensitive layer containing at least a binding resin and a charge transporting material is provided on a photosensitive layer support base with a wall thickness of 0.7 mm or less, wherein the charge transporting material is constituted by a hole transporting material and an electron transporting material, a content of the hole transporting material is 130 parts by mass or less and a content of the electron transporting material is 5 parts by mass or more with respect to 100 parts by mass of the binding resin, and a sum total of the hole transporting material and the electron transporting material is 140 parts by mass or less.

DETAILED DESCRIPTION

Hereinafter, embodiments of the present disclosure will be described. However, the present disclosure is not limited to these embodiments.

[First Embodiment]

Figure 1A:
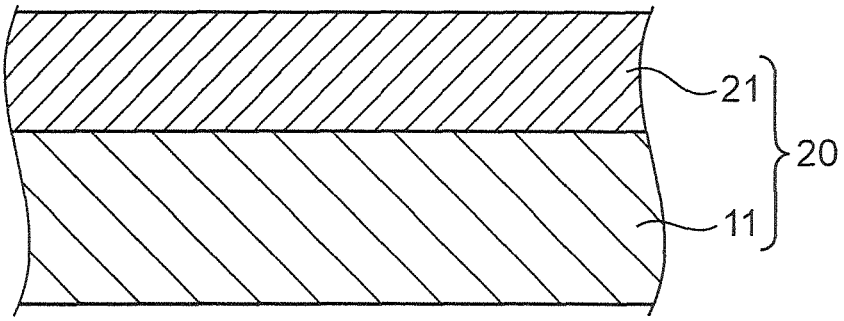
FIGS. 1A and 1B are diagrams showing a configuration of a single-layer photoreceptor according to the present disclosure.
Figure 1B:
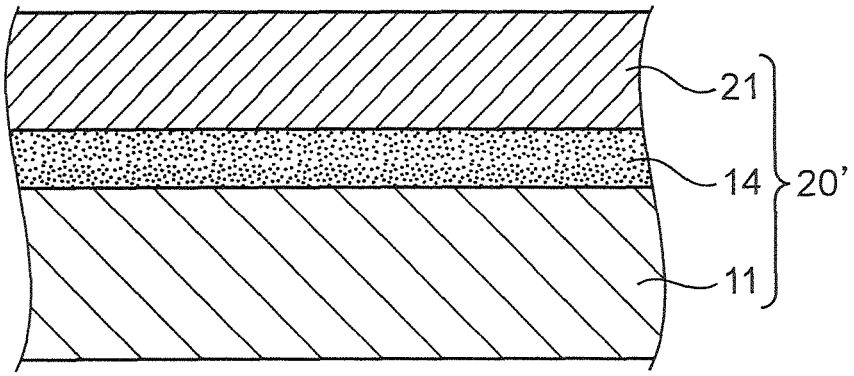

A first embodiment of the present disclosure is related to a positively-charged single-layer electrophotographic photoreceptor. As shown in FIG. 1A, a positively-charged single-layer electrophotographic photoreceptor 20 according to the present embodiment comprises a photosensitive layer support base 11 and a single-layer photosensitive layer 21 which is formed using a photosensitive layer application liquid containing a specific solvent on the photosensitive layer support base 11 and which contains a charge generating material, a charge transporting material, and a binding resin. In this case, the positively-charged single-layer electrophotographic photoreceptor 20 is not particularly limited as long as the positively-charged single-layer electrophotographic photoreceptor 20 comprises the photosensitive layer support base 11 and the photosensitive layer 21. Specifically, for example, the photosensitive layer 21 may be directly provided on the photosensitive layer support base 11 or an intermediate layer 14 may be provided between the photosensitive layer support base 11 and the photosensitive layer 21 as shown in FIG. 1B. Alternatively, the photosensitive layer 21 may be exposed as an outermost layer or a protective layer (not shown) may be provided on the photosensitive layer 21.

Hereinafter, the photosensitive layer support base and the photosensitive layer will be described in this order.

[Photosensitive Layer Support Base]

The photosensitive layer support base (hereinafter, also referred to as an elementary tube) used in the present embodiment is not particularly limited as long as the photosensitive layer support base can be normally used as a photosensitive layer support base of a positively-charged single-layer electrophotographic photoreceptor. Specifically, for example, at least a surface portion of the photosensitive layer support base is constituted by a conductive material. Specific examples include a photosensitive layer support base made of a conductive material or a photosensitive layer support base in which a surface of a plastic material or the like is covered by a conductive material. In addition, examples of conductive materials include aluminum, iron, copper, tin, platinum, silver, vanadium, molybdenum, chromium, cadmium, titanium, nickel, palladium, indium, stainless steel, and brass. Furthermore, as the conductive material, a conductive material may be used alone or two or more conductive materials may be combined and used as an alloy or the like. Among the above, the photosensitive layer support base is favorably made of aluminum or an aluminum alloy. Accordingly, a positively-charged single-layer electrophotographic photoreceptor capable of forming more preferable images can be provided. This is conceivably due to the fact that charges move from the photosensitive layer to the photosensitive layer support base in a preferable manner.

A wall thickness of the photosensitive layer support base according to the present embodiment is 0.7 mm or less, and favorably 0.60 mm or less from the perspective of reducing weight of a photosensitive drum. In addition, as reduced heat capacity due to thinner walls causes a solvent to vaporize, the photosensitive layer support base cools down more readily. Therefore, from the perspective of preventing blushing and also from the perspective of mechanical strength, the wall thickness is favorably 0.4 mm or more and more favorably 0.5 mm or more.

Although a diameter of the photosensitive layer support base according to the present embodiment is not particularly limited and photosensitive layer supports with diameters within a wide range may be used as appropriate, for example, the diameter favorably ranges from 20 mm to 40 mm from the perspectives of reducing size and weight of a photosensitive drum.

[Photosensitive Layer]

The photosensitive layer included in the positively-charged single-layer electrophotographic photoreceptor according to the present embodiment can be used as a photosensitive layer of a positively-charged single-layer electrophotographic photoreceptor, at least contains a binding resin and a charge transporting material, and a content of the charge transporting material is 145 parts by mass or less with respect to 100 parts by mass of the binding resin. In this case, a charge transporting material refers to a hole transporting material (HTM) and/or an electron transporting material (ETM).

The photosensitive layer is a single-layer photosensitive layer in which a charge transporting material is dispersed together with a charge generating material in a same photosensitive layer.

A single-layer photosensitive layer is formed by coating a photosensitive layer support base with an application liquid created by dissolving or dispersing a charge generating material, a charge transporting material, and a binding resin in a suitable organic solvent and drying the application liquid. Such a single-layer photosensitive layer is advantageous in that the photosensitive layer has a simple layer construction and high productivity, coating defects in the photosensitive layer can be suppressed, optical characteristics can be improved due to a smaller interface area between layers, electron transportation performance can be improved and a photoreceptor with higher sensitivity can be obtained since the photosensitive layer contains both an electron transporting material and electron acceptors. In this case, a component ratio of the binding resin and the charge transporting material refers to a ratio of a sum total of the binding resin and the charge transporting material.

The photosensitive layer is formed by coating the photosensitive layer support with a photosensitive layer-forming application liquid in which the respective components described above are dissolved or dispersed according to a known method in an order corresponding to a desired layer construction and by drying the photosensitive layer-forming application liquid.

(Binding Resin)

The binding resin is not particularly limited as long as the binding resin can be used as a binding resin that is contained in a photosensitive layer of a positively-charged single-layer electrophotographic photoreceptor. Specific examples of resins that can be preferably used as the binding resin include: thermoplastic resins such as polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinylchloride resins, polypropylene resins, ionomers, vinyl chloride-vinyl acetate copolymers, polyester resins, alkyd resins, polyamide resins, polyurethane resins, polyarylate resins, polysulfone resins, diallyl phthalate resins, ketone resins, polyvinyl butyral resins, and polyether resins; thermosetting resins such as silicone resins, epoxy resins, phenol resins, urea resins, melamine resins, and other crosslinkable thermosetting resins; and photocurable resins such as epoxy acrylate resins and urethane-acrylate copolymer resins. These resins may be used alone or two or more resins may be used in combination.

Among these resins, since a photosensitive layer with excellent balance among processability, mechanical characteristics, optical characteristics, and abrasion resistance can be obtained, polycarbonate resins such as a bisphenol Z polycarbonate resin, a bisphenol ZC polycarbonate resin, a bisphenol C polycarbonate resin, a bisphenol A polycarbonate resin, and copolymer polycarbonates and polyarylate resins having these resins as skeletons are more favorable.

(Charge Generating Material)

The charge generating material (CGM) is not particularly limited as long as the charge generating material can be used as a charge generating material of a positively-charged single-layer electrophotographic photoreceptor. Specific examples include powders of inorganic photoconducting materials such as x-type metal-free phthalocyanine (x-H2Pc) represented by chemical formula (1) below, y-type oxotitanyl phthalocyanine (y-TiOPc), perylene pigments, bisazo pigments, dithioketo pyrrolopyrrole pigments, metal-free naphthalocyanine pigments, metal naphthalocyanine pigments, squaraine pigments, trisazo pigments, indigo pigments, azulenium pigments, cyanine pigments, selenide, selenide-tellurium, selenide-arsenic, cadmium sulfide, and amorphous silicon, pyrylium salts, anthanthrone-based pigments, triphenylmethane-based pigments, indanthrene-based pigments, toluidine-based pigments, pyrazoline-based resins, and quinacridone-based pigments.

[Chemical formula 1]

Formula (1)

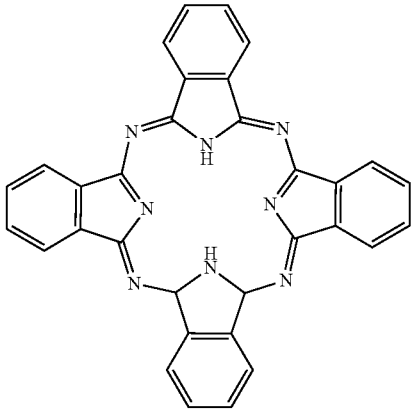

In addition, a charge generating material may be used alone or a two or more charge generating materials may be used in combination so as to have an absorption wavelength in a desired region. Furthermore, since an image forming apparatus of a digital optical system such as a laser beam printer or a facsimile which uses a light source such as a semiconductor laser particularly requires a photoreceptor having sensitivity in a wavelength range of 700 nm or longer, for example, phthalocyanine-based pigments such as metal-free phthalocyanine and oxotitanyl phthalocyanine are preferably used among the charge generating materials listed above. Moreover, a crystalline form of the phthalocyanine-based pigments is not particularly limited and phthalocyanine-based pigments with various crystalline forms may be used. In addition, since an image forming apparatus of an analog optical system such as a static copier that uses a white light source such as a halogen lamp requires a photoreceptor having sensitivity in the visible range, for example, perylene pigments or bisazo pigments are preferably used.

(Hole Transporting Material)

The hole transporting material (HTM) is not particularly limited as long as the hole transporting material can be used as a hole transporting material that is contained in a photosensitive layer of a positively-charged single-layer electrophotographic photoreceptor. Specific examples of the hole transporting material include benzidine derivatives, oxadiazole-based compounds such as 2,5-di(4-methylaminophenyl)-1,3,4-oxadiazole, styryl-based compounds such as 9-(4-diethylaminostyryl)anthracene, carbazole-based compounds such as polyvinyl carbazole, organic polysilane compounds, pyrazoline-based compounds such as 1-phenyl-3-(p-dimethylaminophenyl)pyrazoline, nitrogen-containing cyclic compounds such as hydrazone-based compounds, triphenylamine-based compounds, indole-based compounds, oxadiazole-based compounds, isoxazole-based compounds, triazole-based compounds and triazole-based compounds, and condensed polycyclic compounds. Among these hole transporting materials, triphenylamine-based compounds having one or a plurality of triphenylamine skeletons per molecule are more favorable. These hole transporting materials may be used alone or two or more hole transporting materials may be used in combination.

(Electron Transporting Material)

The electron transporting material (ETM) is not particularly limited as long as the electron transporting material can be used as an electron transporting material that is contained in a photosensitive layer of a positively-charged single-layer electrophotographic photoreceptor. Specific examples include quinone derivatives such as naphthoquinone derivatives, diphenoquinone derivatives, anthraquinone derivatives, azoquinone derivatives, nitroanthraquinone derivatives, and dinitroanthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromo maleic anhydride. These electron transporting materials may be used alone or two or more electron transporting materials may be used in combination.

(Contents of Respective Components)

In the positively-charged single-layer electrophotographic photoreceptor according to the present embodiment, respective contents of the charge generating material (CGM), the hole transporting material (HTM), the electron transporting material (ETM), and the binding resin described above are not particularly limited as long as the content of the hole transporting material is 110 parts by mass or less with respect to 100 parts by mass of the binding resin when the charge transporting material is solely constituted by the hole transporting material or the content of the hole transporting material is 130 parts by mass or less, and the content of the electron transporting material is 5 parts by mass or more with respect to 100 parts by mass of the binding resin when the charge transporting material is constituted by the hole transporting material and the electron transporting material.

Furthermore, when the charge transporting material is solely constituted by the hole transporting material, the content of the hole transporting material is favorably 40 parts by mass or more and 110 parts by mass or less and more favorably 70 parts by mass or more and 100 parts by mass or less with respect to 100 parts by mass of the binding resin.

In addition, when the charge transporting material is constituted by the hole transporting material and the electron transporting material, favorably, the content of the hole transporting material is 50 parts by mass or more and 120 parts by mass or less, and the content of the electron transporting material is 5 parts by mass or more and 50 parts by mass or less and, more favorably, the content of the hole transporting material is 70 parts by mass or more and 110 parts by mass or less, and the content of the electron transporting material is 20 parts by mass or more and 40 parts by mass or less with respect to 100 parts by mass of the binding resin. Furthermore, in this case, a sum total of the hole transporting material and the electron transporting material or, in other words, the content of the charge transporting material is favorably 55 parts by mass or more and 140 parts by mass or less.

Moreover, for example, in the case of a single-layer photosensitive layer, the content of the charge generating material is favorably 0.1 parts by mass or more and 50 parts by mass or less and more favorably 0.5 parts by mass or more and 30 parts by mass or less with respect to 100 parts by mass of the binding resin.

When a component ratio of the charge transporting material relative to the binding resin exceeds the range according to the present embodiment described above, a larger amount of solvent is required to obtain a uniform coating liquid. As a result, an amount of evaporation of the solvent in the coating film after coating increases and heat loss due to heat of vaporization also increases. This causes a surface temperature of the elementary tube to drop below dew point after coating, making blushing due to condensation more likely to occur. In contrast, when the charge transporting material that is a low-molecular-weight component is contained in the component ratio range according to the present embodiment, since a sufficiently uniform photosensitive layer coating liquid can be formed even if the solvent content is low, problems such as those described above do not occur. In order to produce the advantageous effects of the present disclosure in an effective manner, a molecular weight of the charge transporting material is favorably set to 1000 or lower and more favorably set to 800 or lower.

(Additives)

Besides the charge generating material (CGM), the hole transporting material, the electron transporting material, and the binding resin, the photosensitive layer of the positively-charged single-layer electrophotographic photoreceptor may contain various additives as long as electrophotographic characteristics are not adversely affected. Examples of additives that can be added into the photosensitive layer include deterioration preventing agents such as an antioxidant, a radical scavenger, a singlet quencher, and an ultraviolet absorber, a softener, a plasticizer, polyaromatic compounds, a surface modifier, an extender, a thickener, a dispersion stabilizer, a wax, an oil, an acceptor, a donor, a surfactant, and a leveling agent.

[Intermediate Layer]

Moreover, while an intermediate layer is not an essential component of the present disclosure, when the intermediate layer 14 is provided between the photosensitive layer support base 11 and the photosensitive layer 21 as shown in FIG. 1B, the intermediate layer can prevent a charge on the side of a conductive substrate 11 from being introduced into the photosensitive layer, increase bonding strength of the photosensitive layer onto the conductive substrate 11, and coat and smooth defects on a surface of the conductive substrate 11.

(Method of Manufacturing Positively-Charged Single-Layer Electrophotographic Photoreceptor)

The method of manufacturing the positively-charged single-layer electrophotographic photoreceptor is not particularly limited as long as the object of the present disclosure is not inhibited. Preferable examples of methods of manufacturing the positively-charged single-layer electrophotographic photoreceptor include a method of coating a photosensitive layer support base with a photosensitive layer application liquid and forming a photosensitive layer. Specifically, the positively-charged single-layer electrophotographic photoreceptor can be manufactured by coating a photosensitive layer support base with an application liquid created by dissolving or dispersing a charge generating material, a charge transporting material, a binding resin and, as necessary, various additives and the like in a solvent and drying the application liquid. Application methods are not particularly limited and examples thereof include methods using a spin coater, an applicator, a spray coater, a bar coater, a dip coater, or a doctor blade. Among these application methods, a dipping method using a dip coater enables continuous production and achieves economic efficiency and is therefore favorable. In addition, methods of drying a coating film that is formed on the photosensitive layer support base include performing hot air drying at 80 to 150° C. for 15 to 120 minutes.

The solvent contained in the photosensitive layer application liquid is not particularly limited as long as the solvent can dissolve or disperse the respective components that make up the photosensitive layer. Specific examples include: alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, methyl isobutyl ketone, and cyclohexanone; esters such as ethyl acetate and methyl acetate; and aprotic polar organic solvents such as dimethyl formaldehyde, dimethyl formamide, and dimethyl sulfoxide. These solvents may be used alone or two or more solvents may be used in combination.

A thickness of the photosensitive layer of the positively-charged single-layer electrophotographic photoreceptor is not particularly limited as long as sufficient action as a photosensitive layer can be produced. Specifically, for example, the thickness of the photosensitive layer is favorably 5 μm or more and 100 μm or less and more favorably 10 μm or more and 50 μm or less.

[Second Embodiment]

A second embodiment of the present disclosure is an image forming apparatus comprising an image carrier, a contact-charging charging member which applies a direct current voltage for charging a surface of the image carrier, an exposure member which exposes the charged surface of the image carrier to form an electrostatic latent image on the surface of the image carrier, a developing member which develops the electrostatic latent image as a toner image, and a transfer member which transfers the toner image from the image carrier to a material to be transferred, wherein the positively-charged single-layer electrophotographic photoreceptor according to the first embodiment is used as the image carrier.

As the image forming apparatus according to the present embodiment, known image forming apparatuses can be adopted without particular limitations. Although a tandem-type color image forming apparatus that uses toners of a plurality of colors is favorable among known image forming apparatuses, the present embodiment is not limited thereto. More specifically, a tandem-type color image forming apparatus that uses toners of a plurality of colors as described below may be used.

In order to form a toner image by a toner of each different color on each surface, the image forming apparatus comprising the positively-charged single-layer electrophotographic photoreceptor according to the present embodiment comprises a plurality of image carriers juxtaposed in a predetermined direction and a plurality of developing members which are arranged so as to oppose each image carrier and which have developing rollers that carry and transport toner on a surface thereof and respectively supply the transported toner to a surface of each image carrier, wherein the positively-charged single-layer electrophotographic photoreceptor is respectively used as each of the image carriers.

Figure 2:
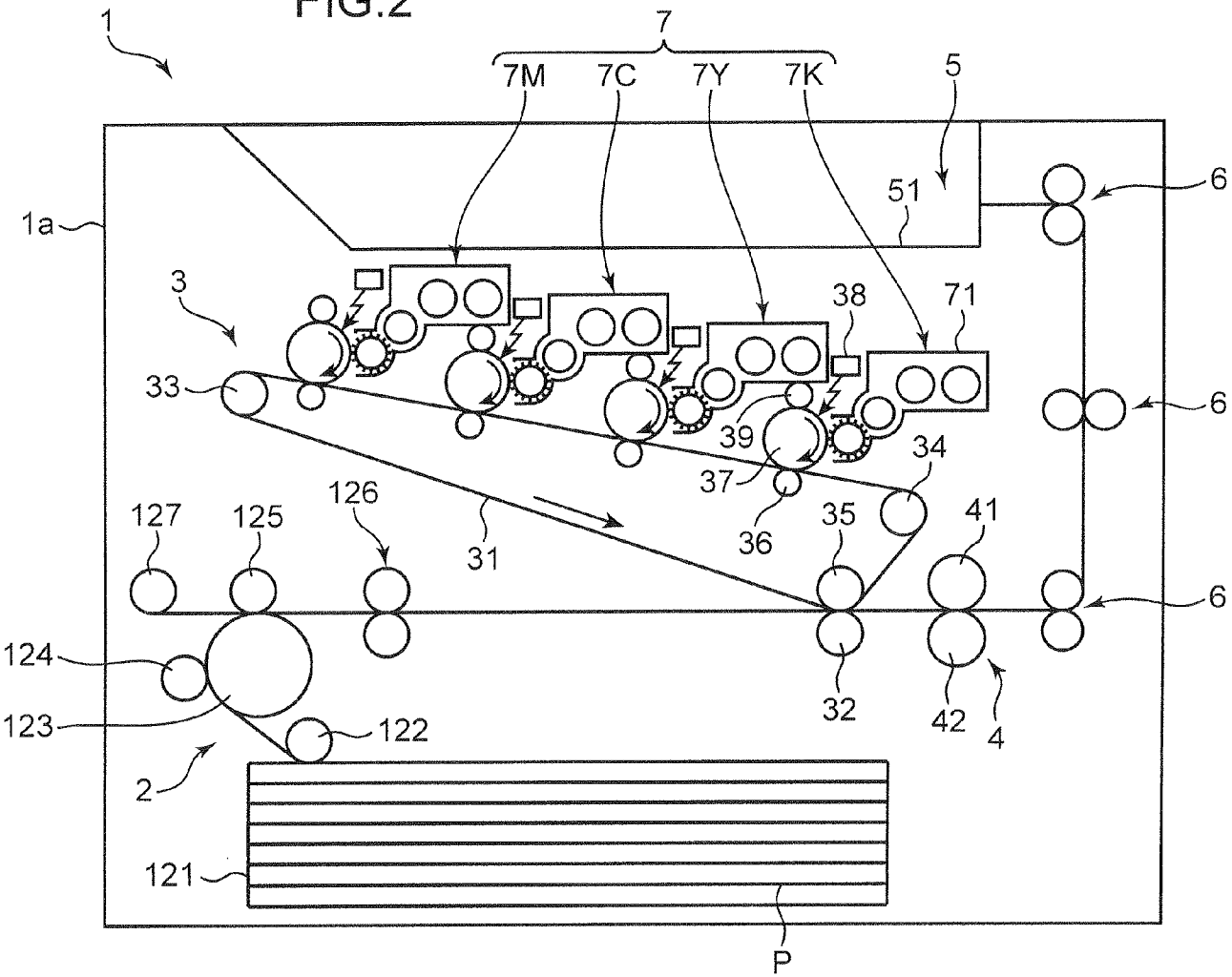
FIG. 2 is a schematic diagram showing a configuration of an image forming apparatus comprising a positively-charged single-layer electrophotographic photoreceptor according to a second embodiment of the present disclosure.

FIG. 2 is a schematic diagram showing a configuration of an image forming apparatus comprising a positively-charged single-layer electrophotographic photoreceptor according to the present embodiment. The image forming apparatus will now be describing using a color printer 1 as an example.

As shown in FIG. 2, the color printer 1 includes a box-like apparatus main body 1*a*. Provided inside the apparatus main body 1*a* are a paper feeding member 2 which feeds a sheet of paper P, an image forming member 3 which transfers a toner image based on image data or the like on the sheet of paper P that is fed from the paper feeding member 2 while transporting the sheet of paper P, and a fixing member 4 which fixes, on the sheet of paper P, an unfixed toner image transferred on the sheet of paper P by the image forming member 3. Furthermore, a paper discharge member 5 which discharges the sheet of paper P subjected to a fixing process by the fixing member 4 is provided on an upper surface of the apparatus main body 1*a*.

The paper feeding member 2 comprises a paper cassette 121, a pickup roller 122, paper feeding rollers 123, 124, and 125, and a resist roller 126. The paper cassette 121 is provided so as to be insertable to and removable from the apparatus main body 1*a* and stores sheets of paper P of respective sizes. The pickup roller 122 is provided at a position to the left and above the paper cassette 121 as shown in FIG. 2, and ejects the sheets of paper P stored in the paper cassette 121 one sheet at a time. The paper feeding rollers 123, 124, and 125 send the sheet of paper P ejected by the pickup roller 122 to a paper conveying path. The resist roller 126 temporarily places the sheet of paper P sent to the paper conveying path by the paper feeding rollers 123, 124, and 125 on standby and supplies the sheet of paper P to the image forming member 3 at a predetermined timing.

The paper feeding member 2 further comprises a manual feed tray (not shown) to be mounted to a left side surface of the apparatus main body 1*a* shown in FIG. 2 and a pickup roller 127. The pickup roller 127 ejects a sheet of paper P placed in the manual feed tray. The sheet of paper P ejected by the pickup roller 127 is sent to the paper conveying path by the paper feeding rollers 123, 124, and 125 and supplied by the resist roller 126 to the image forming member 3 at a predetermined timing.

The image forming member 3 comprises an image forming unit 7, an intermediate transfer belt 31 with a surface (a contact surface) on which a toner image based on image data transmitted from a computer or the like is primary-transferred by the image forming unit 7, and a secondary transfer roller 32 which performs secondary transfer of the toner image on the intermediate transfer belt 31 to the sheet of paper P sent from the paper cassette 121.

The image forming unit 7 comprises a black unit 7K, a yellow unit 7Y, a cyan unit 7C, and a magenta unit 7M which are sequentially arranged from an upstream side (a right side in FIG. 2) to a downstream side. In each of the units 7K, 7Y, 7C, and 7M, a positively-charged single-layer electrophotographic photoreceptor 37 (hereinafter, referred to as a photoreceptor 37) as an image carrier is arranged at a center position so as to be rotatable in a direction depicted by an arrow (clockwise). In addition, a charging member 39, an exposure member 38, a developing member 71, a cleaning member (not shown), a static eliminator (not shown) as a static eliminating member, and the like are respectively arranged around each photoreceptor 37 in sequence from an upstream side in the direction of rotation. Moreover, the positively-charged single-layer electrophotographic photoreceptor according to the first embodiment is used as the photoreceptor 37.

The charging member 39 uniformly charges a circumferential surface of the electrophotographic photoreceptor 37 that is being rotated in the direction of the arrow. The charging member 39 is not particularly limited as long as the circumferential surface of the electrophotographic photoreceptor 37 can be uniformly charged and may adopt a non-contact system or a contact system. Specific examples of the charging member 39 include a corona charging apparatus, a charging roller, and a charging brush. A contact charging apparatus such as a charging roller or a charging brush is more favorable. The use of a contact charging member 39 suppresses discharge of active gases such as ozone or nitrogen oxides generated by the charging member 39, enables degradation of the photosensitive layer of the electrophotographic photoreceptor due to active gas to be prevented, and enables design which takes office environment and the like into consideration to be adopted.

The charging member 39 comprising the contact charging roller charges the circumferential surface (surface) of the photoreceptor 37 while keeping the charging roller in contact with the photoreceptor 37. Examples of such a charging roller include a charging roller which rotates along with a rotation of the photoreceptor 37 while remaining in contact with the photoreceptor 37. In addition, examples of such a charging roller include a roller in which at least a surface portion thereof is made of resin. More specifically, examples of such a charging roller include a charging roller comprising a rotatably supported metal core, a resin layer formed on the metal core, and a voltage applying member which applies voltage to the metal core. With the charging member 39 comprising such a charging roller, by applying voltage to the metal core from the voltage applying member, a surface of the photoreceptor 37 which is in contact via the resin layer can be charged.

Favorably, the voltage applied to the charging roller by the voltage applying member is solely a direct current voltage. The direct current voltage that is applied to the electrophotographic photoreceptor by the charging roller is favorably 1000 V to 2000 V, more favorably 1200 V to 1800 V, and particularly favorably 1400 V to 1600 V. Compared to cases where an alternating current voltage or a superposed voltage created by superposing an alternating current voltage on a direct current voltage is applied to the charging roller, applying only a direct current voltage to the charging roller tends to reduce the amount of wear of the photosensitive layer.

In addition, the resin that constitutes the resin layer of the charging roller is not particularly limited as long as the circumferential surface of the photoreceptor 37 can be preferably charged. Specific examples of the resin used in the resin layer include silicone resins, urethane resins, and modified silicone resins. Furthermore, the resin layer may contain an inorganic filler.

The exposure member 38 is a so-called laser scanning unit which irradiates laser light based on image data inputted from a personal computer (PC) that is an upper-level apparatus on the circumferential surface of the photoreceptor 37 that is uniformly charged by the charging member 39 to form an electrostatic latent image based on the image data on the photoreceptor 37. The developing member 71 supplies toner to the circumferential surface of the photoreceptor 37 on which the electrostatic latent image is formed in order to form a toner image based on the image data. The toner image is then primary-transferred to the intermediate transfer belt 31. After the primary transfer of the toner image to the intermediate transfer belt 31 is finished, the cleaning member cleans the toner remaining on the circumferential surface of the photoreceptor 37. The static eliminator eliminates static from the circumferential surface of the photoreceptor 37 after the primary transfer is finished. After being subjected to the cleaning process by the cleaning member and the static eliminator, the circumferential surface of the photoreceptor 37 proceeds toward the charging member 39 for a new cleaning process and is subjected to the new cleaning process.

The intermediate transfer belt 31 is an endless belt-like rotating body which is suspended across a plurality of rollers including a driving roller 33, a driven roller 34, a backup roller 35, and a primary transfer roller 36 so that a surface (contact surface) side of the intermediate transfer belt 31 abuts circumferential surfaces of the respective photoreceptors 37. In addition, the intermediate transfer belt 31 is configured so as to be endlessly rotated by the plurality of rollers in a state where the intermediate transfer belt 31 is pushed against the respective photoreceptors 37 by the primary transfer roller 36 that is arranged so as to oppose the photoreceptors 37. The driving roller 33 is rotationally driven by a drive source such as a stepping motor and imparts a drive force for endlessly rotating the intermediate transfer belt 31. The driven roller 34, the backup roller 35, and the primary transfer roller 36 are rotatably provided and are driven so as to rotate along with the endless rotation of the intermediate transfer belt 31 due to the driving roller 33. The rollers 34, 35, and 36 are driven so as to rotate via the intermediate transfer belt 31 in accordance with a main driving rotation of the driving roller 33 and support the intermediate transfer belt 31.

The primary transfer roller 36 applies a primary transfer bias (with a reverse polarity to a charging polarity of the toners) to the intermediate transfer belt 31. Accordingly, the toner images formed on the respective photoreceptors 37 are sequentially transferred (primary-transferred) in a multi-coated state on the intermediate transfer belt 31 which revolves in a direction of an arrow (counter-clockwise) due to the driving of the driving roller 33 between the respective photoreceptors 37 and the primary transfer roller 36.

The secondary transfer roller 32 applies a secondary transfer bias with a reverse polarity to the toner images to the sheet of paper P. Accordingly, the toner images primary-transferred on the intermediate transfer belt 31 are transferred to the sheet of paper P between the secondary transfer roller 32 and the backup roller 35. As a result, a color transfer image (an unfixed toner image) is transferred to the sheet of paper P.

The fixing member 4 performs a fixing process on a transfer image that has been transferred to the sheet of paper P at the image forming member 3 and comprises a heating roller 41 which is heated by a conductive heat generator and a pressure roller 42 which is arranged so as to oppose the heating roller 41 and whose circumferential surface is pushed so as to abut a circumferential surface of the heating roller 41.

The transfer image that has been transferred to the sheet of paper P by the secondary transfer roller 32 at the image forming member 3 is fixed to the sheet of paper P by a fixing process due to heating when the sheet of paper P passes between the heating roller 41 and the pressure roller 42. Subsequently, the sheet of paper P subjected to the fixing process is discharged to the paper discharge member 5. In addition, with the color printer 1 according to the present embodiment, a conveying roller 6 is arranged at an appropriate location between the fixing member 4 and the paper discharge member 5.

The paper discharge member 5 is formed by depressing a summit of the apparatus main body 1*a* of the color printer 1, and a paper discharge tray 51 which accepts the discharged sheet of paper P is formed in a bottom portion of the formed recess.

The color printer 1 performs image formation on the sheet of paper P according to an image forming operation such as that described above. In addition, since a tandem-type image forming apparatus such as that described above comprises the positively-charged single-layer electrophotographic photoreceptor according to the first embodiment as an image carrier, an image forming apparatus capable of preventing an abrupt decline in charge potential in an initial stage of use of the positively-charged single-layer electrophotographic photoreceptor and capable of forming preferable images can be obtained even under conditions where a contact charging system of applying a direct current voltage that may not necessarily provide preferable charging efficiency is used as a charging system and a charge potential on a surface of the positively-charged single-layer electrophotographic photoreceptor cannot be readily stabilized.

EXAMPLES

Hereinafter, the present disclosure will be described in greater detail by way of examples. It is to be understood that the examples do not limit the present disclosure in any way.

(Preparation of Photosensitive Layer Application Liquid)

100 parts by mass of a bisphenol Z polycarbonate resin as a binding resin and a predetermined amount shown in Tables 1 to 4 of a hole transporting material or an electron transporting material that is a charge transporting material were dissolved in a minimum amount of tetrahydrofuran (THF) necessary for dissolving the resin and the charge transporting material. In addition, after adding 3 parts by mass of a charge generating material (metal-free phthalocyanine) and 0.1 parts by mass of a leveling agent (KF-96-50CS manufactured by Shin-Etsu Chemical Co., Ltd.) to an amount of THF that is 50% of the amount of THF which was required to dissolve the resin and the charge transporting material, a pigment dispersed liquid subjected to ultrasonic dispersion for one minute was added. The THF solution of the binding resin and the pigment dispersed liquid mixture were further dispersed for 20 minutes by a dispersion mill to prepare a photosensitive layer application liquid.

(Fabrication of Photoreceptor)

A photosensitive layer was formed by a dipping method so as to obtain a photosensitive layer with a film thickness of 35 μm after drying on a 30 mm-diameter, 250 mm-length thick-walled cylindrical aluminum tube shown in Tables 1 to 4 whose surface had been cleaned and which had been processed to attain a predetermined wall thickness. Coating was performed in a 23° C., 60% RH environment. The aluminum tube coated with the application liquid was placed in room temperature for minutes and then subjected to heat treatment at 100° C. for 30 minutes to obtain a positively-charged single-layer electrophotographic photoreceptor.

(Evaluation of Occurrence of Blushing)

The dried photosensitive layer was checked visually to observe and judge whether crystals have been created on the surface due to coagulation of the charge transporting material.

Tables 1 and 2 show, as examples, results of a blushing evaluation of photoreceptors including photosensitive layers which contain the charge transporting material in amounts within the range according to the present disclosure. Tables 3 and 4 show, as comparative examples, results of a blushing evaluation of photoreceptors including photosensitive layers which contain the charge transporting material in amounts exceeding the range according to the present disclosure. In the tables, when blushing was not occurred, the result of "CTM crystallization" was indicated as "OK". To the contrary, when blushing was occurred, it was indicated as "NG".

TABLE 1

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Example 1 | (1) | 110 | — | 0 | 110 | 0.70 | OK |
| Example 2 | (2) | 110 | — | 0 | 110 | 0.70 | OK |
| Example 3 | (3) | 110 | — | 0 | 110 | 0.70 | OK |
| Example 4 | (1) | 100 | — | 0 | 100 | 0.70 | OK |
| Example 5 | (2) | 100 | — | 0 | 100 | 0.70 | OK |
| Example 6 | (1) | 90 | — | 0 | 90 | 0.70 | OK |
| Example 7 | (1) | 70 | — | 0 | 70 | 0.70 | OK |
| Example 8 | (2) | 70 | — | 0 | 70 | 0.70 | OK |
| Example 9 | (3) | 70 | — | 0 | 70 | 0.70 | OK |
| Example 10 | (1) | 40 | — | 0 | 40 | 0.70 | OK |
| Example 11 | (3) | 40 | — | 0 | 40 | 0.70 | OK |
| Example 12 | (1) | 130 | I | 5 | 135 | 0.70 | OK |
| Example 13 | (2) | 130 | I | 5 | 135 | 0.70 | OK |
| Example 14 | (3) | 130 | I | 5 | 135 | 0.70 | OK |
| Example 15 | (1) | 130 | II | 5 | 135 | 0.70 | OK |
| Example 16 | (2) | 130 | II | 5 | 135 | 0.70 | OK |
| Example 17 | (3) | 130 | II | 5 | 135 | 0.70 | OK |
| Example 18 | (2) | 130 | III | 5 | 135 | 0.70 | OK |
| Example 19 | (1) | 130 | II | 10 | 140 | 0.70 | OK |
| Example 20 | (2) | 130 | II | 10 | 140 | 0.70 | OK |
| Example 21 | (3) | 130 | II | 10 | 140 | 0.70 | OK |
| Example 22 | (1) | 130 | III | 10 | 140 | 0.70 | OK |
| Example 23 | (2) | 130 | III | 10 | 140 | 0.70 | OK |
| Example 24 | (3) | 130 | III | 10 | 140 | 0.70 | OK |
| Example 25 | (1) | 120 | I | 5 | 125 | 0.70 | OK |
| Example 26 | (1) | 120 | II | 5 | 125 | 0.70 | OK |
| Example 27 | (2) | 120 | III | 5 | 125 | 0.70 | OK |
| Example 28 | (1) | 120 | II | 10 | 130 | 0.70 | OK |
| Example 29 | (2) | 120 | I | 10 | 130 | 0.70 | OK |
| Example 30 | (1) | 100 | I | 20 | 120 | 0.70 | OK |
| Example 31 | (1) | 100 | I | 30 | 130 | 0.70 | OK |
| Example 32 | (1) | 100 | I | 40 | 140 | 0.70 | OK |
| Example 33 | (2) | 90 | II | 50 | 140 | 0.70 | OK |
| Example 34 | (3) | 90 | II | 50 | 140 | 0.70 | OK |
| Example 35 | (1) | 70 | I | 5 | 75 | 0.70 | OK |
| Example 36 | (2) | 70 | I | 10 | 80 | 0.70 | OK |

TABLE 1-continued

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Example 37 | (3) | 70 | I | 50 | 120 | 0.70 | OK |
| Example 38 | (1) | 60 | II | 10 | 70 | 0.70 | OK |
| Example 39 | (2) | 60 | II | 30 | 90 | 0.70 | OK |
| Example 40 | (3) | 60 | II | 50 | 110 | 0.70 | OK |
| Example 41 | (1) | 50 | III | 5 | 55 | 0.70 | OK |
| Example 42 | (2) | 50 | III | 5 | 55 | 0.70 | OK |
| Example 43 | (3) | 50 | III | 5 | 55 | 0.70 | OK |

TABLE 2

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Example 44 | (1) | 110 | — | 0 | 110 | 0.60 | OK |
| Example 45 | (2) | 110 | — | 0 | 110 | 0.60 | OK |
| Example 46 | (3) | 110 | — | 0 | 110 | 0.60 | OK |
| Example 47 | (1) | 100 | — | 0 | 100 | 0.60 | OK |
| Example 48 | (2) | 100 | — | 0 | 100 | 0.60 | OK |
| Example 49 | (1) | 90 | — | 0 | 90 | 0.60 | OK |
| Example 50 | (1) | 70 | — | 0 | 70 | 0.60 | OK |
| Example 51 | (2) | 70 | — | 0 | 70 | 0.60 | OK |
| Example 52 | (3) | 70 | — | 0 | 70 | 0.60 | OK |
| Example 53 | (1) | 40 | — | 0 | 40 | 0.60 | OK |
| Example 54 | (3) | 40 | — | 0 | 40 | 0.60 | OK |
| Example 55 | (1) | 130 | I | 5 | 135 | 0.60 | OK |
| Example 56 | (2) | 130 | I | 5 | 135 | 0.60 | OK |
| Example 57 | (3) | 130 | I | 5 | 135 | 0.60 | OK |
| Example 58 | (1) | 130 | II | 5 | 135 | 0.60 | OK |
| Example 59 | (2) | 130 | II | 5 | 135 | 0.60 | OK |
| Example 60 | (3) | 130 | II | 5 | 135 | 0.60 | OK |
| Example 61 | (2) | 130 | III | 5 | 135 | 0.60 | OK |
| Example 62 | (1) | 100 | I | 20 | 120 | 0.60 | OK |
| Example 63 | (1) | 100 | I | 30 | 130 | 0.60 | OK |
| Example 64 | (1) | 100 | I | 40 | 140 | 0.60 | OK |
| Example 65 | (2) | 90 | II | 50 | 140 | 0.60 | OK |
| Example 66 | (3) | 90 | II | 50 | 140 | 0.60 | OK |
| Example 67 | (1) | 110 | — | 0 | 110 | 0.50 | OK |
| Example 68 | (2) | 110 | — | 0 | 110 | 0.50 | OK |
| Example 69 | (3) | 110 | — | 0 | 110 | 0.50 | OK |
| Example 70 | (1) | 100 | — | 0 | 100 | 0.50 | OK |
| Example 71 | (2) | 100 | — | 0 | 100 | 0.50 | OK |
| Example 72 | (1) | 90 | — | 0 | 90 | 0.50 | OK |
| Example 73 | (1) | 70 | — | 0 | 70 | 0.50 | OK |
| Example 74 | (2) | 70 | — | 0 | 70 | 0.50 | OK |
| Example 75 | (3) | 70 | — | 0 | 70 | 0.50 | OK |
| Example 76 | (1) | 40 | — | 0 | 40 | 0.50 | OK |
| Example 77 | (3) | 40 | — | 0 | 40 | 0.50 | OK |
| Example 78 | (1) | 130 | I | 5 | 135 | 0.50 | OK |
| Example 79 | (2) | 130 | I | 5 | 135 | 0.50 | OK |
| Example 80 | (3) | 130 | I | 5 | 135 | 0.50 | OK |
| Example 81 | (1) | 130 | II | 5 | 135 | 0.50 | OK |
| Example 82 | (2) | 130 | II | 5 | 135 | 0.50 | OK |
| Example 83 | (3) | 130 | II | 5 | 135 | 0.50 | OK |
| Example 84 | (2) | 130 | III | 5 | 135 | 0.50 | OK |
| Example 85 | (1) | 100 | I | 20 | 120 | 0.50 | OK |
| Example 86 | (1) | 100 | I | 30 | 130 | 0.50 | OK |
| Example 87 | (1) | 100 | I | 40 | 140 | 0.50 | OK |
| Example 88 | (2) | 90 | II | 50 | 140 | 0.50 | OK |
| Example 89 | (3) | 90 | II | 50 | 140 | 0.50 | OK |

TABLE 3

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Comparative Example 1 | (1) | 120 | — | 0 | 120 | 0.70 | NG |
| Comparative Example 2 | (1) | 115 | — | 0 | 115 | 0.70 | NG |
| Comparative Example 3 | (2) | 115 | — | 0 | 115 | 0.70 | NG |
| Comparative Example 4 | (3) | 115 | — | 0 | 115 | 0.70 | NG |
| Comparative Example 5 | (1) | 90 | I | 55 | 145 | 0.70 | NG |
| Comparative Example 6 | (2) | 90 | I | 55 | 145 | 0.70 | NG |
| Comparative Example 7 | (3) | 90 | I | 55 | 145 | 0.70 | NG |
| Comparative Example 8 | (1) | 90 | II | 55 | 145 | 0.70 | NG |
| Comparative Example 9 | (2) | 90 | II | 55 | 145 | 0.70 | NG |
| Comparative Example 10 | (3) | 90 | II | 55 | 145 | 0.70 | NG |
| Comparative Example 11 | (1) | 135 | I | 5 | 140 | 0.70 | NG |
| Comparative Example 12 | (2) | 135 | I | 5 | 140 | 0.70 | NG |
| Comparative Example 13 | (3) | 135 | I | 5 | 140 | 0.70 | NG |
| Comparative Example 14 | (1) | 135 | I | 10 | 145 | 0.70 | NG |
| Comparative Example 15 | (2) | 135 | I | 10 | 145 | 0.70 | NG |
| Comparative Example 16 | (3) | 135 | I | 10 | 145 | 0.70 | NG |
| Comparative Example 17 | (1) | 135 | II | 10 | 145 | 0.70 | NG |
| Comparative Example 18 | (2) | 135 | II | 10 | 145 | 0.70 | NG |
| Comparative Example 19 | (3) | 135 | II | 10 | 145 | 0.70 | NG |
| Comparative Example 20 | (1) | 130 | I | 3 | 133 | 0.70 | NG |
| Comparative Example 21 | (2) | 130 | I | 3 | 133 | 0.70 | NG |
| Comparative Example 22 | (3) | 130 | I | 3 | 133 | 0.70 | NG |
| Comparative Example 23 | (1) | 130 | II | 3 | 133 | 0.70 | NG |
| Comparative Example 24 | (2) | 130 | II | 3 | 133 | 0.70 | NG |
| Comparative Example 25 | (3) | 130 | II | 3 | 133 | 0.70 | NG |
| Comparative Example 26 | (2) | 130 | III | 3 | 133 | 0.70 | NG |

TABLE 4

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Comparative Example 27 | (1) | 120 | — | 0 | 120 | 0.60 | NG |
| Comparative Example 28 | (1) | 115 | — | 0 | 115 | 0.60 | NG |
| Comparative Example 29 | (2) | 115 | — | 0 | 115 | 0.60 | NG |
| Comparative Example 30 | (3) | 115 | — | 0 | 115 | 0.60 | NG |
| Comparative Example 31 | (1) | 120 | — | 0 | 120 | 0.50 | NG |

TABLE 4-continued

| | HTM | | ETM | | CTM total | Elementary tube wall | |
|---|---|---|---|---|---|---|---|
| | Compound | Pts. mass. | Compound | Pts. mass. | pts. mass. | thickness (mm) | CTM crystallization |
| Comparative Example 32 | (1) | 115 | — | 0 | 115 | 0.50 | NG |
| Comparative Example 33 | (2) | 115 | — | 0 | 115 | 0.50 | NG |
| Comparative Example 34 | (3) | 115 | — | 0 | 115 | 0.50 | NG |
| Comparative Example 35 | (1) | 135 | II | 5 | 140 | 0.60 | NG |
| Comparative Example 36 | (2) | 135 | I | 5 | 140 | 0.60 | NG |
| Comparative Example 37 | (3) | 135 | III | 5 | 140 | 0.60 | NG |
| Comparative Example 38 | (2) | 130 | I | 3 | 133 | 0.60 | NG |
| Comparative Example 39 | (3) | 130 | I | 3 | 133 | 0.60 | NG |
| Comparative Example 40 | (1) | 130 | II | 3 | 133 | 0.60 | NG |
| Comparative Example 41 | (2) | 130 | II | 3 | 133 | 0.60 | NG |
| Comparative Example 42 | (2) | 130 | III | 3 | 133 | 0.60 | NG |
| Comparative Example 43 | (1) | 135 | II | 5 | 140 | 0.50 | NG |
| Comparative Example 44 | (2) | 135 | I | 5 | 140 | 0.50 | NG |
| Comparative Example 45 | (3) | 135 | III | 5 | 140 | 0.50 | NG |
| Comparative Example 46 | (2) | 130 | I | 3 | 133 | 0.50 | NG |
| Comparative Example 47 | (3) | 130 | I | 3 | 133 | 0.50 | NG |
| Comparative Example 48 | (1) | 130 | II | 3 | 133 | 0.50 | NG |
| Comparative Example 49 | (2) | 130 | II | 3 | 133 | 0.50 | NG |
| Comparative Example 50 | (2) | 130 | III | 3 | 133 | 0.50 | NG |

<Evaluated Materials>

Hole Transporting Material (HTM)

(1) 1,4-bis{4-[N-(2-ethyl-6-methyl)phenyl-N-phenyl]aminostyryl}benzene (2) N,N'-bis-[4-(2-phenylethene-1-yl)-phenyl]-N,N'-bis(2-ethyl-6-methylphenyl)-1,1'-biphenyl-4,4'-diamine (3) 1,1'-bis(4-diethylaminophenyl)-4,4'-diphenyl-1,3-butadiene Electron Transporting Material (ETM)

I: 4,4'-tert-amyl-1,1'-bisnaphthyl-4,4'-quinone

II: 2-benzyloxycarbonyl-3-phenyl-1,4-naphthoquinone

III: 2-benzoyl-3-phenyl-1,4-naphthoquinone

While blushing was not observed during formation of a photosensitive layer in the examples where the charge transporting material was added to the photosensitive layer application liquid so as to satisfy conditions according to the present disclosure, blushing occurred in the photosensitive layer in the comparative examples where the charge transporting material was added outside of the conditions according to the present disclosure.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A positively-charged single-layer electrophotographic photoreceptor in which a photosensitive layer, containing at least a binding resin and a charge transporting material, is carried directly on a photosensitive layer support base with a wall thickness of 0.5 mm to 0.7 mm, wherein the charge transporting material includes only a hole transporting material, and wherein the photosensitive layer includes a content of the hole transporting material of 40 parts by mass to 110 parts by mass with respect to 100 parts by mass of the binding resin, and at least a surface portion of the photosensitive layer support base is constituted by a conductive metal.

2. An image forming apparatus comprising:

an image carrier;

a charging member which charges a surface of the image carrier;

an exposure member which exposes the charged surface of the image carrier to form an electrostatic latent image on the surface of the image carrier;

a developing member which develops the electrostatic latent image as a toner image, and a transfer member which transfers the toner image from the image carrier to a material to be transferred, wherein the image carrier is the positively-charged single-layer electrophotographic photoreceptor according to claim 1.

3. A positively-charged single-layer electrophotographic photoreceptor in which a photosensitive layer, containing at least a binding resin and a charge transporting material, is carried directly on a photosensitive layer support base with a wall thickness of 0.5 to 0.7 mm, wherein the charge transporting material includes a hole transporting material and an electron transporting material, wherein the photosensitive layer includes a content of the hole transporting material of 50 parts by mass to 130 parts by mass and a content of the electron transporting material of 5 parts by mass to 50 parts by mass with respect to 100 parts by mass of the binding resin, wherein a sum total of the hole transporting material and the electron transporting material is 140 parts by mass or less with respect to 100 parts by mass of the binding resin, and at least a surface portion of the photosensitive layer support base is constituted by a conductive metal.

4. The positively-charged single-layer electrophotographic photoreceptor according to claim 3, wherein the hole transporting material is at least one selected from 1,4-bis{4[N-(2-ethyl-6-methyl)phenyl-N-phenyl] aminostyryl}benzene, N,N'-bis[4-(2-phenylethene-1-yl)-phenyl]-N,N'-bis(2-ethyl-6-methylphenyl)-1,1'-biphenyl-4,4'-diamine, and 1,1'-bis(4-diethylaminophenyl)-4,4'-diphenyl-1,3-butadiene.

5. The positively-charged single-layer electrophotographic photoreceptor according to claim 3, wherein the electron transporting material is at least one selected from 4,4'-tert-amyl-1,1'-bisnaphthyl-4,4'-quinone, 2-benzyloxycarbonyl-3-phenyl-1,4-naphthoquinone, and 2-benzoyl-3-phenyl-1,4-naphthoquinone.

6. The positively-charged single-layer electrophotographic photoreceptor according to claim 3, wherein the photosensitive layer further includes a charge generating material.

7. The positively-charged single-layer electrophotographic photoreceptor according to claim 3, wherein the photosensitive layer is a blushing-free photosensitive layer.

8. An image forming apparatus comprising:

an image carrier;

a charging member which charges a surface of the image carrier;

an exposure member which exposes the charged surface of the image carrier to form an electrostatic latent image on the surface of the image carrier;

a developing member which develops the electrostatic latent image as a toner image, and a transfer member which transfers the toner image from the image carrier to a material to be transferred, wherein the image carrier is the positively-charged single-layer electrophotographic photoreceptor according to claim 3.

* * * * *